US006726143B1

(12) United States Patent
Mills

(10) Patent No.: US 6,726,143 B1
(45) Date of Patent: Apr. 27, 2004

(54) LINE WINDING APPARATUS

(76) Inventor: Roger O. Mills, Rte. 1 Box 39, Seneca, MO (US) 64865

( * ) Notice: Subject to any disclaimer, the term of this patent is extended or adjusted under 35 U.S.C. 154(b) by 0 days.

(21) Appl. No.: 10/283,941

(22) Filed: Oct. 30, 2002

(51) Int. Cl.[7] ..... B65H 75/24
(52) U.S. Cl. ..... 242/575.2; 242/597.2; 242/486.9
(58) Field of Search ..... 242/575.3, 575.2, 242/597.2, 486.9, 902

(56) References Cited

U.S. PATENT DOCUMENTS

| | | | | | |
|---|---|---|---|---|---|
| 1,470,373 | A | * | 10/1923 | Barrier | 242/376 |
| 2,012,452 | A | * | 8/1935 | Littell | 242/575.2 |
| 2,280,012 | A | * | 4/1942 | Stasio | 242/575.2 |
| 3,295,787 | A | | 1/1967 | Golonka | 242/129.8 |
| 4,310,126 | A | | 1/1982 | Norleen | 242/484.2 |
| 4,540,136 | A | | 9/1985 | Rauch | 242/396.9 |
| 4,717,086 | A | | 1/1988 | Crow | 242/486.9 |
| 4,728,048 | A | | 3/1988 | Batson | 242/486.8 |
| 4,762,286 | A | | 8/1988 | Crow | 242/486.9 |
| 4,776,527 | A | | 10/1988 | Prowant | 242/591 |
| 5,056,732 | A | * | 10/1991 | Nicholson, Jr. | 242/470 |
| 5,060,878 | A | | 10/1991 | Hutzenlaub et al. | 242/592 |
| 5,163,632 | A | | 11/1992 | Chilcoat et al. | 242/486.9 |
| 5,522,565 | A | * | 6/1996 | Deshaies | 242/575.2 |

* cited by examiner

*Primary Examiner*—Kathy Matecki
*Assistant Examiner*—Evan Langdon
(74) *Attorney, Agent, or Firm*—William R. Sharp

(57) ABSTRACT

The invention is an apparatus for winding line onto a spool having a hub with an inner surface defining a central cavity therein, wherein the apparatus comprises: a header having a longitudinal axis and opposing first and second sides; a pair of prongs transversely and outwardly extending from the first side of the header; a prong adjustment means for adjusting the longitudinal separation between the prongs, which as received in the cavity of the spool can be adjusted to be in snug contact with said inner surface to thereby securely hold the spool; a shaft affixed to the header so as to transversely and outwardly extend from the second side thereof; and a rotation means for rotating the shaft to thereby also rotate the header and prongs, such that the spool as securely held by the prongs is rotatable by rotation of the shaft so as to permit winding of line upon the spool.

15 Claims, 1 Drawing Sheet

LINE WINDING APPARATUS

BACKGROUND OF THE INVENTION

The invention relates to an apparatus for winding line onto a spool, such as that type of spool employed in weed and grass trimmers.

The spool of a weed and grass trimmer has a mono filament (i.e. nylon) line wound thereon for cutting vegetation. After all of the line has been used, the empty spool is removable from the trimmer for reloading. New line is wound onto the spool, usually by hand, from a suitable bulk supply of line. However, the flexible but relatively stiff line tends to tangle and resists tight and compact winding upon the spool, thus making winding by hand a difficult and tedious task. The typical result is a poorly and unevenly wound spool from which line can twist and/or break during use.

Various devices have been developed for winding line onto the spool of a weed and grass trimmer. However, such devices have not been universally adaptable to the wide variety of spools on the market having different inside diameters and structural configurations. The inside diameter is the diameter of the cavity defined within the hub of the spool. One type of line winder includes a cone-shaped member engaged with the hub of the spool on one side thereof, a second member (either cone-shaped or flat) engaged with the spool on its opposite side, and a spindle extending through the hub and connecting the members to thereby clamp the spool between the members. Although the cone-shaped member accommodates spools with different inside diameters, this type of line winder is limited to use with spools of a specific structural design. The hub of the spool must define a central cavity extending completely through the spool in order to receive the spindle which connects the two members.

SUMMARY OF THE INVENTION

It is, therefore, an object of the invention to provide an apparatus or winding line onto a spool which is universally adaptable for use with spools having different inside diameters as well as structural configurations.

The above object is realized by an apparatus for winding line onto a spool having a hub with an inner surface defining a central cavity therein, wherein the apparatus comprises: a header having a longitudinal axis and opposing first and second sides; a pair of prongs transversely and outwardly extending from the first side of the header; a prong adjustment means for adjusting the longitudinal separation between the prongs, which as received in the cavity of the spool can be adjusted to be in snug contact with said inner surface to thereby securely hold the spool; a shaft affixed to the header so as to transversely and outwardly extend from the second side thereof; and a rotation means for rotating the shaft to thereby also rotate the header and prongs, such that the spool as securely held by the prongs is rotatable by rotation of the shaft so as to permit winding of line upon the spool.

Adjustment of the longitudinal separation of the prongs allows for use of the apparatus with spools having different inside diameters. The apparatus can also be used with spools of virtually any structural configuration as long as the spool has a hub defining a cavity therein that can securely receive the prongs. The prongs can be received in the cavity to securely hold the spool regardless of whether the cavity extends only partially or completely through the spool.

According to a preferred embodiment hereafter described, the above-mentioned rotation means Is a crank handle for manually rotating the shaft within a bearing means (i.e. tubular sleeve). The bearing means is affixed to a mounting mean s (i.e. resilient tubular clip) for being fixedly but removably mounted to a supporting member, such as the tubular member of a weed and grass trimmer. The preferred prong adjustment means comprises another shaft rotatably mounted within the header and having oppositely threaded portions for respectively and threadedly receiving the prongs.

BRIEF DESCRIPTION OF THE DRAWINGS

FIG. 2 is a plan view showing the open side of a header and internal details. FIG. 3 is a view showing one end of the header.

DESCRIPTION OF A PREFERRED EMBODIMENT

Figure 1:
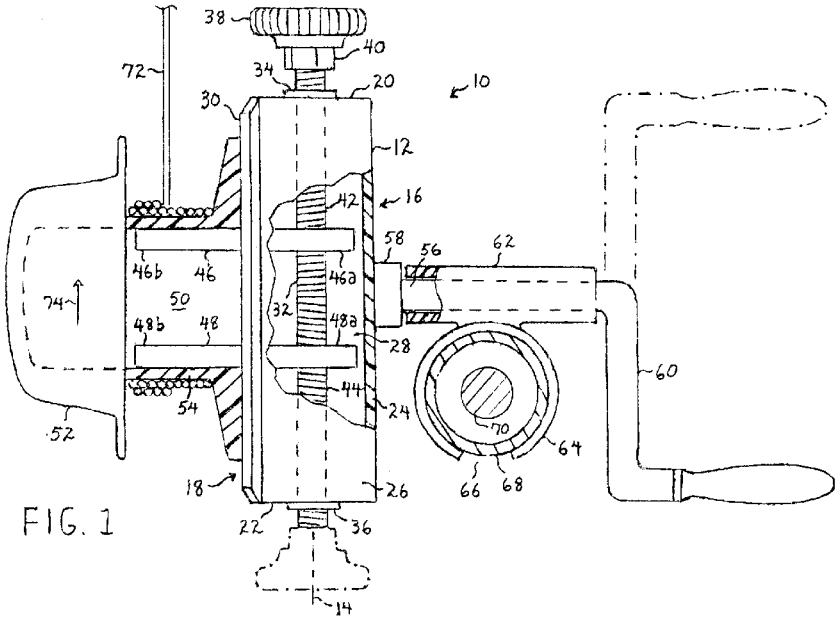
FIG. 1 is a view of a preferred embodiment of the apparatus as it appears in use for winding line upon a spool. The apparatus is shown as having the spool secured thereto. The apparatus is also mounted to a supporting member.

Referring to FIG. 1, the illustrated apparatus 10 includes a header 12 that is hollow so as to define an interior therein. Header 12 has a longitudinal axis 14, opposing sides 16 and 18, and longitudinally opposing ends 20 and 22. Side 16 is closed and is defined by a wall 24 longitudinally extending between ends 20 and 22. Wall 26 transversely extends between sides 16 and 18 and longitudinally extends between ends 20 and 22. A longitudinally extending flange 30 outwardly extends from wall 26 at side 18. A portion of wall 26 is broken away to reveal the interior of header 12 and the interior surface of opposing wall 28, which is similar to wall 26 and has an associated flange not visible in FIG. 1. Walls 26 and 28 define side 18, which is open in a manner more clearly shown in subsequent FIG. 2.

Continuing to refer to FIG. 1, a threaded shaft 32 longitudinally extends through the interior of header 12 and is rotatably mounted between ends 20 and 22. Opposing end portions of shaft 32 are rotatably received through holes in ends 20 and 22. Lock washers 34 and 36 are received over the end portions of shaft 32 so as to abut the respective exterior surfaces of ends 20 and 22 to thereby retain shaft 32 in the illustrated longitudinal position while allowing its rotation. A knob 38 is affixed to the outermost extremity of one end portion of shaft 32 to allow manual rotation thereof. Knob 38 can, for example, be threaded upon the one end portion of shaft 32 and fixed in position upon the shaft by a lock nut 40. As shown, shaft 32 has threaded portions 42 and 44 of opposite hand, i.e. one portion having right hand threads and the other portion having left hand threads. Threaded portion 42 threadedly receives the inner end 46*a* of a prong 46, and threaded portion 44 threadedly receives the inner end 48*a* of a prong 48. The respective inner ends 46*a* and 48*a* of prongs 46 and 48 are accordingly received in the interior of header 12. Each prong extends from its inner end inside header 12 to its opposing outer end outside the header. The outer ends of prongs 46 and 48 are indicated at 46*b* and 48*b*, respectively. FIG. 1 further shows that prongs 46 and 48 transversely and outwardly extend from side 18 of header 12.

Portions of prongs 46 and 48 extending outwardly from side 18 are received in a central cavity 50 as defined within a spool 52 by the inner surface its hub 54 (shown in cross section). Cavity 50 extends only partially through spool 52. As will be explained further below, prongs 46 and 48 are adjusted in their longitudinal separation to be in snug contact with the inner surface of hub 54 to thereby securely hold spool 52. The outer edge of flange 30 (as well as the outer edge of the flange not shown in FIG. 1) is in contact with an outer face of spool 52. Spool 52 can be of the type removed from a weed and grass trimmer, as previously discussed.

A shaft 56 is affixed to header 12 so as to transversely and outwardly extend from side 16. One end of shaft 56 is affixed to side 16, as defined by wall 24, by means of a boss 58 integrally formed with wall 24 and having a recess (not shown) in which the end of shaft 56 is fixedly received with a suitable adhesive. The other end of shaft 56 is affixed to, and preferably integral with (as shown), a crank handle 60.

A tubular sleeve 62 (a portion being shown in cross section) rotatably receives shaft 56 therethrough. AS shown, the opposing ends of tubular sleeve 62 are closely adjacent to boss 58 and crank handle 60. A resilient tubular clip 64 is affixed to, and preferably integral with, tubular sleeve 62 so as to be perpendicularly oriented with respect to the tubular sleeve. Tubular clip 64 has a wall with a slot 66. Since tubular clip 64 is comprised of a resilient material, the tubular clip is adapted to receive a tubular supporting member 68 through slot 66 and into the interior of the clip as shown. Tubular clip 64 is thereby fixedly but removably mounted to tubular supporting member 68. Tubular supporting member 68 is most conveniently the tubular member of the weed and grass trimmer from which spool 52 was removed. A drive shaft 70 is shown as being coaxially positioned within tubular supporting member 68. A weed and grass trimmer of the type using an internal combustion engine has such a drive shaft extending through the tubular member between the engine and trimmer head (not shown). Both tubular supporting member 68 and drive shaft 70 are illustrated in cross section.

Assuming tubular supporting member 68 is the tubular member of a weed and grass trimmer, the trimmer can be positioned by the user in any suitably comfortable position (not shown) while standing or sitting, while the user turns crank handle 60 with one hand and tightly holds replacement line from a bulk supply of line with the other hand. Turning of crank handle 60 is indicated in FIG. 1 by the position of the crank handle, as shown in phantom lines, after 180° in rotation. Accordingly, shaft 56 is rotated within tubular sleeve 62 to thereby also rotate header 12, prongs 46 and 48, and spool 52 as securely held by the prongs so as to wind line 72 evenly and tightly around hub 54 of spool 52. Rotation of header 12 is indicated by knob 38 in phantom lines after 180° of rotation (which would orient prongs 46 and 48 oppositely from that shown), and rotation of spool 52 is indicated by arrow 74. Of course, tubular sleeve 62, tubular clip 64, and tubular supporting member 68 remain stationary during winding of line 72 upon spool 52. The winding operation in accordance with the invention is performed easily and quickly, and results in a properly wound spool to thereby avoid the previously mentioned problems of twisting and/or breakage during use of the weed and grass trimmer.

Figure 2:
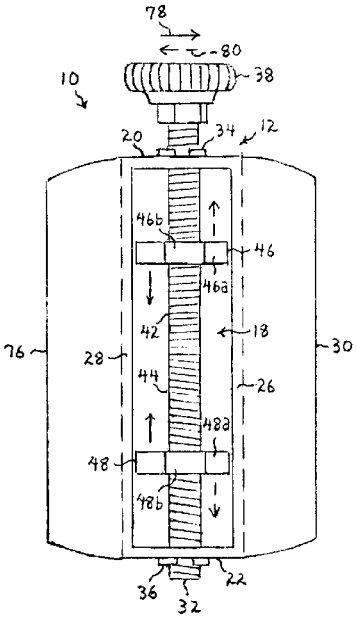
FIGS. 2 and 3 illustrate different views of the apparatus as it appears when not in use. Therefore, the apparatus does not have a spool secured thereto and is not mounted to a supporting member.

Referring to FIG. 2, this view of apparatus 10 (without a spool secured thereto) clearly shows open side 18 as defined by walls 26 and 28 that longitudinally extend between ends 20 and 22, as well as flange 30 and the other flange 76 respectively and outwardly extending from walls 26 and 28 at side 18. Walls 26 and 28 have spaced interior surfaces between which inner ends **46*a* and 48*a* of prongs 46 and 48 are closely received for longitudinal movement within header 12. Those portions of prongs 46 and 48 outwardly extending from open side 18 to their respective outer ends 46*b* and 48*b* are preferably rectangular in shape and have a smaller width than inner ends 46*a* and 48*a*. Because of oppositely threaded portions 42 and 44 of shaft 32 which respectively and threadedly receive inner ends 46*a* and 48*a*, rotation of knob 38 in one rotational direction (as indicated by solid arrow 78) moves prongs 46 and 48 toward one another (as indicated by corresponding solid arrows within header 12), and rotation of knob 38 in the opposite rotational direction (as indicated by broken arrow 80) moves prongs 46 and 48 away from one another (as indicated by corresponding broken arrows within header 12**).

Accordingly, longitudinal separation of prongs 46 and 48 can be adjusted to be slightly less than the inside diameter of a spool to allow the prongs to be received inside the spool's cavity, followed by appropriate rotation of knob 38 to move prongs 46 and 48 away from one another and into snug contact with the inner surface of the hub that defines the cavity (as is shown in FIG. 1). The spool, as thus securely held by prongs 46 and 48, is removed from the prongs by appropriate rotation of knob 38 to move the prongs toward one another and out of contact with the above-mentioned inner surface.

Figure 3:
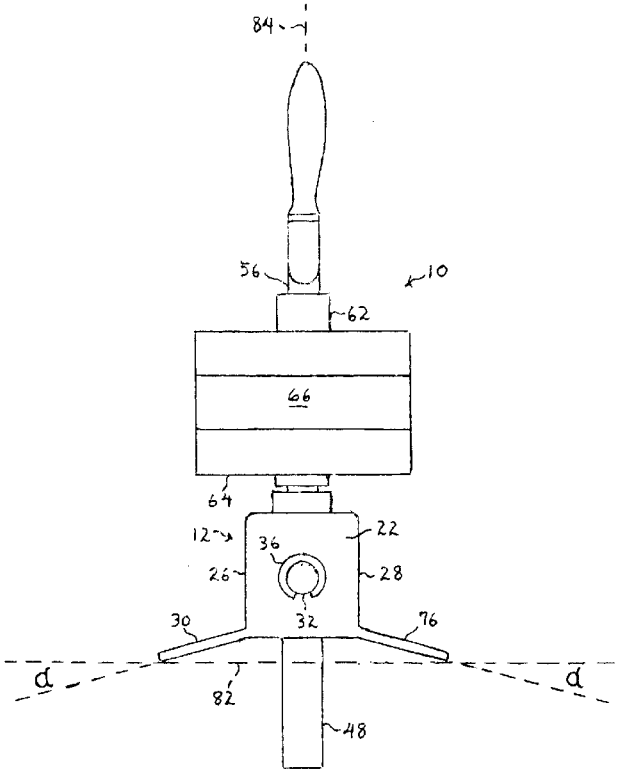

Referring to FIG. 3, this view of apparatus 10 (without a spool secured thereto) shows the respective outer edges of flanges 30 and 76 lying in a plane, as represented by the broken line at 82, that intersects the prongs (of which only prong 48 is visible in FIG. 2). Plane 82 is also perpendicular to the rotational axis 84 of shaft 56. Plane 82 preferably defines an acute angle a of about 10–20° with respect to each of flanges 30 and 76. The outer edges of flanges 30 and 76 are, therefore, adapted to contact the face of a spool as held by the prongs. This ensures that the spool remains in a fixed relationship to header 12 during winding and does not "wobble", even if the spool is slightly warped and its face is not absolutely flat. FIG. 3 further shows tubular clip 64 without a tubular supporting member received therein. Slot 66 is shown as axially extending between the opposing ends of tubular clip 64.

Some preferred dimensions for apparatus 10 will now be given for illustrative purposes, but should not be construed to limit the invention in any manner: inside (as measured between interior surfaces) dimensions of header 12—2⅜ inch long and ½ inch wide; size and threading of threaded shaft 32—¼ inch diameter and 20–28 threads per inch; rectangular dimensions of the portions of prongs 46 and 48 extending from side 18 to respective outer ends **46*b* and 48*b*–⅛×¼ inch; inside diameter of tubular clip 64—¾ inch. The specified dimensions of the prongs and header allow the apparatus to be used with a spool having any inside diameter between about ⅜ inch about 2 ¼ inch. This range of inside diameters covers virtually all trimmer spools on the market. The specified inside diameter of tubular clip 64 allows its use with any tubular member of a weed and grass trimmer having an outside diameter of about ¾ to 1 inch. The resiliency of tubular clip 64 allows it to deform sufficiently to accommodate a tubular member having an outside diameter at the upper end of the specified range. The tubular members of virtually all trimmers on the market have an outside diameter within this range. With respect to preferred materials of construction, apparatus 10 can be made entirely of plastic materials to minimize cost of production. Header 12, shaft 56 and crank handle 60, as well as tubular sleeve 62 can be comprised of any suitably strong and rigid plastic. Tubular clip 64 can be comprised of any suitably resilient plastic with a good "memory". Threaded shaft 32, as well as prongs 46 and 48**, can be comprised of a tough and durable plastic such as nylon. Alternatively, the threaded shaft and prongs could be metallic, preferably aluminum. Obviously, many modifications and variations of the present invention are possible in light of the above teachings. For example, the apparatus of the invention could be used with a spool other than the type from a weed and grass trimmer, and the tubular clip could be fixedly but removably mounted to a different tubular supporting member. Or, a different mounting mechanism could be substituted for the tubular clip for being mounted to any of various types of supporting members. According to another variation, the shaft affixed to the header could be rotated by a motorized device rather than manually with a crank handle. Rotation with the crank handle is preferred, however, for its simplicity and the ability to control the speed of rotation. It is, therefore, to be understood that the invention can be practiced otherwise than as specifically described.

That which is claimed is:

1. An apparatus for winding line onto a spool having a hub with an inner surface defining a central cavity therein, said apparatus comprising:

a header that is hollow and has a longitudinal axis, longitudinally opposing ends, an interior defined therein, and opposing first and second sides;

a pair of prongs transversely and outwardly extending from the first side of the header;

a prong adjustment means for adjusting the longitudinal separation between the prongs, which as received in the cavity of the spool can be adjusted to be in snug contact with said inner surface to thereby securely hold the spool, the prong adjustment means including a first shaft upon which the prongs are adjustable received and which longitudinally extends from one end to the other end of the header in the interior thereof;

a second shaft affixed to the header so as to transversely and outwardly extend from the second side thereof; and a second shaft rotation means for rotating the Second shaft to thereby also rotate the header and prongs, such that the spool as securely held by the prongs is rotatable by rotation of the second shaft so as to permit winding of line upon the spool.

2. An apparatus as recited in claim 1 wherein the first side of the header is open, and each of the prongs has opposing first and second ends of which the first ends are received in the interior of the header so that such prongs are longitudinally movable toward or away from one another by the prong adjustment means, each prong extending from the first end inside the header to the second end outside the header.

3. An apparatus as recited in claim 2 wherein the first shaft is rotatably mounted between the ends of the header, and has threaded portions of opposite hand of which one threaded portion threadedly receives the first end of one prong and the other portion threadedly receives the first end of the other prong, and wherein the prong adjustment means further includes a first shaft rotation means for rotating the first shaft so that rotation in one direction moves the prongs toward one another and rotation in the opposite direction moves the prongs away from one another.

4. An apparatus as recited in claim 3 wherein the ends of the header have respective holes therethrough, the first shaft has opposing end portions rotatably received through the respective holes, and the first shaft rotation means comprises a knob affixed to one end portion of the first shaft to allow manual rotation thereof.

5. An apparatus as recited in claim 4 wherein the second side of the header is closed and the header includes a wall means transversely extending between the sides of the header and longitudinally extending between the ends of the header, the wall means having spaced interior surfaces between which the first end of each prong is closely received for longitudinal movement.

6. An apparatus as recited in claim S wherein the wall means comprises first and second walls defining the open first side of the header, and wherein the header further includes a third wall defining the closed second side of the header and longitudinally extending between the ends of the header.

7. An apparatus as recited in claim 6 wherein the header has a longitudinally extending first flange outwardly extending from the first wall at the open first side and a longitudinally extending second flange outwardly extending from the second wall at the open first side.

8. An apparatus as recited in claim 7 wherein the second shaft has a rotational axis, and wherein the first and second flanges have respective outer edges lying in a plane that intersects the prongs and is perpendicular to the rotational axis of the second shaft, the outer edges of the flanges being adapted to contact the spool when it is securely held by the prongs.

9. An apparatus as recited in claim 8 wherein said plane defines an acute angle of about 10–20° with respect to each of the first and second flanges.

10. An apparatus as recited In claim 1 wherein the apparatus is for use with a supporting member and further comprises: a bearing means through which the second shaft is rotatably received; and a mounting means, affixed to the bearing means, for being fixedly but removably mounted to the supporting member.

11. An apparatus as recited in claim 10 wherein the mounting means comprises a resilient tubular clip having an interior defined therein and a wall with a slot, the tubular clip being adapted to receive a tubular supporting member through the slot and into the interior of the clip.

12. An apparatus as recited in claim 11 wherein the bearing means comprises a tubular sleeve.

13. An apparatus as recited in claim 12 wherein the second shaft rotation means comprises a crank handle, and wherein the second shaft has opposing ends of which one end is affixed to the second side of the header and the other end is affixed to the crank handle.

14. An apparatus for winding line onto a spool having a hub with an inner surface defining a central cavity therein, said apparatus being for use with a tubular supporting member and comprising:

a header having a longitudinal axis and opposing first and second sides:

a pair of prongs transversely and outwardly extending from the first side of the header;

a prong adjustment means for adjusting the longitudinal separation between the prongs, which as received in the cavity of the spool can be adjusted to be in snug contact with said inner surface to thereby securely hold the spool;

a shaft affixed to the header so as to transversely and outwardly extend from the second side thereof;

a bearing means through which the shaft is rotatably received;

a resilient tubular clip affixed to the bearing means and having an interior defined therein, there being an exterior outside the tubular clip and the tubular clip further having opposing open ends and a wall with a slot extending between the open ends so as to provide communication between the interior and exterior along the length of the slot between the open ends, wherein the tubular clip is adapted to receive the tubular supporting member through the slot and into the interior of the tubular clip to thereby fixedly but removably mount the tubular clip to the tubular supporting member; and a rotation means for rotating the shaft to thereby also rotate the header and prongs;

whereby the spool as securely held by the prongs is rotatable by rotation of the shaft so as to permit winding of line upon the spool while the tubular clip is removably mounted on the tubular supporting member.

15. An apparatus for winding line onto a spool having a hub with an inner surface defining a central cavity therein, said apparatus comprising;

a header that is hollow and has a longitudinal axis, longitudinally opposing ends, and interior defined therein, and opposing first and second sides;

a pair of prongs transversely and outwardly extending from the first side of the header;

a prong adjustment means for adjusting the longitudinal separation between the prongs, which as received in the cavity of the spool can be adjusted to be in snug contact with said inner surface to thereby securely hold the spool, the prong adjustment means including (i) a longitudinally extending first shaft in the interior of the header and rotatably mounted between the ends of the header, the first shaft having opposing end portions rotatably received by respective ends of the header and also having a pair of integral threaded portions of opposite hand of which one threaded portion extends from one end portion to the other threaded portion and such other threaded portion extends to the other end portion, wherein one threaded portion threadedly receives one prong and the other threaded portion threadedly receives the other prong, and (ii) a first shaft rotation means for rotating the first shaft so that rotation in one direction moves the prongs toward one another and rotation in the opposite direction moves the prongs away from one another;

a second shaft affixed to the header so as to transversely and outwardly extend from the second side thereof: and a second shaft rotation means for rotating the second shaft to thereby also rotate the header and prongs, such that the spool as securely held by the prongs is rotatable by rotation of the second shaft so as to permit winding of line upon the spool.

* * * * *

UNITED STATES PATENT AND TRADEMARK OFFICE

CERTIFICATE OF CORRECTION

PATENT NO. : 6,726,143 B1
DATED : April 27, 2004
INVENTOR(S) : Roger O. Mills

It is certified that error appears in the above-identified patent and that said Letters Patent is hereby corrected as shown below:

Column 5,
Line 34, “adjustable” should read -- adjustably --.

Column 6,
Line 8, “S” should read -- 5 --.

Signed and Sealed this

Thirteenth Day of July, 2004

JON W. DUDAS
*Acting Director of the United States Patent and Trademark Office*